US009815314B2

(12) United States Patent
Duzy et al.

(10) Patent No.: US 9,815,314 B2
(45) Date of Patent: Nov. 14, 2017

(54) METHODS FOR PRINTING ARTICLES

(71) Applicant: Hewlett-Packard Industrial Printing LTD, Netanya (IL)

(72) Inventors: Eyal Duzy, Nes-Ziona (IL); Shahar Admon, Netanya (IL); Benjamin Dayan, Tel-Aviv (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 20 days.

(21) Appl. No.: 14/226,434

(22) Filed: Mar. 26, 2014

(65) Prior Publication Data

US 2014/0302289 A1 Oct. 9, 2014

(30) Foreign Application Priority Data

Apr. 4, 2013 (EP) ..... 13162355

(51) Int. Cl.
*B41M 5/00* (2006.01)
*B41M 7/00* (2006.01)

(52) U.S. Cl.
CPC ..... *B41M 7/0081* (2013.01); *B41M 5/0011* (2013.01); *B41M 7/0045* (2013.01); *Y10T 428/24851* (2015.01)

(58) Field of Classification Search
CPC ..... B41M 5/00; Y10T 428/24802
See application file for complete search history.

(56) References Cited

U.S. PATENT DOCUMENTS

| | | | | |
|---|---|---|---|---|
| 7,504,441 | B2 | 3/2009 | Narayan-Sarathy et al. | |
| 2002/0119295 | A1 | 8/2002 | Speer et al. | |
| 2002/0121631 | A1* | 9/2002 | Rahman | C09D 4/00 252/500 |
| 2003/0021961 | A1* | 1/2003 | Ylitalo et al. | 428/195 |
| 2006/0075917 | A1 | 4/2006 | Edwards | |
| 2007/0154632 | A1 | 7/2007 | Schaefer et al. | |
| 2009/0104373 | A1 | 4/2009 | Vanbesien et al. | |
| 2009/0226632 | A1* | 9/2009 | Oberski et al. | 427/511 |
| 2009/0233198 | A1* | 9/2009 | Kakino | 430/66 |
| 2011/0118377 | A1 | 5/2011 | Hauck et al. | |
| 2013/0029046 | A1* | 1/2013 | Heischkel | C09D 11/101 427/256 |
| 2013/0090407 | A1* | 4/2013 | Carter | C08G 59/027 522/170 |
| 2013/0116644 | A1* | 5/2013 | Wei | A61L 15/56 604/361 |

FOREIGN PATENT DOCUMENTS

| | | | |
|---|---|---|---|
| DE | WO 2011124262 A1 * | 10/2011 | C09D 11/101 |
| EP | 1333073 | 8/2003 | |
| EP | 1362710 | 11/2003 | |
| EP | 2508349 | 10/2012 | |
| EP | 2666832 | 11/2013 | |
| JP | 2007099948 | 4/2007 | |
| WO | WO 02/085638 | 10/2002 | |
| WO | WO 2008/030555 | 3/2008 | |
| WO | PCT/IL2013/050089 | 1/2013 | |
| WO | WO 2013/054317 | 4/2013 | |

* cited by examiner

*Primary Examiner* — Gerard Higgins
*Assistant Examiner* — Sathavaram I Reddy
(74) *Attorney, Agent, or Firm* — Dierker & Kavanaugh, P.C.

(57) ABSTRACT

Methods of printing articles using a photo-curable adhesion promoter and varnish composition jetted onto a media substrate, and a printed article are described.

13 Claims, 2 Drawing Sheets

METHODS FOR PRINTING ARTICLES

BACKGROUND

Inkjet technology has expanded its application to high-speed, commercial and industrial printing, in addition to home and office usage, because of its ability to produce economical, high quality, multi-colored prints. This technology is a non-impact printing method in which an electronic signal controls and directs droplets or a stream of ink that can be deposited on a wide variety of substrates.

Inks used in such technologies can be liquid dispersions, solution, or emulsions and can include oil-based inks, non-aqueous solvent based inks, water-based inks and solid inks. Current inkjet printing technology involves forcing the ink drops through small nozzles by thermal ejection, piezoelectric pressure or oscillation, onto the surface of a media substrate. The deposited ink droplets are, then, dried, e.g., using heat or forced air, or photo curable mechanism, or allowed to dry at ambient conditions.

Curing of ink by radiation, and in particular ultraviolet (UV) curing, has become popular. In these cases, special ink is used and the image is cured by exposure to a radiation source. The uses of such radiation-curable (or photo-curable) inks and the curing process are rapidly becoming an alternative to the established conventional drying process.

However, radiation-curable (or photo-curable) ink compositions are noticeably limited among available options due to their specific features. UV curable technology enables usage of a broad media range. On certain media types such as polyolefins (polyethylenes and polypropylenes) and acrylics it is common to use adhesion compositions or adhesion promoters or primers to improve adhesion of photo-curable inks to media substrates.

It is also common to protect printed articles, such as posters, signage prints, and articles intended to be formed into packaging items, with a clear protective layer such as a clear varnish after an ink has been printed. A protective layer is typically used to increase the robustness of both the printed ink and the substrate itself. For example, a varnish may protect the printed image and the substrate from being scratched or scuffed or rubbed, as well as adding a degree of water resistance, and better lightfastness.

DETAILED DESCRIPTION

Before particular embodiments of the present disclosure are disclosed and described, it is to be understood that the present disclosure is not limited to the particular process and materials disclosed herein. It is also to be understood that the terminology used herein is used for descriptive purposes only and is not intended to be limiting, as the scope of protection will be defined by the claims and equivalents thereof.

In describing and claiming the composition and methods, the following terminology will be used: the singular forms "a", "an", and "the" include plural referents unless the context clearly dictates otherwise. Thus, for example, reference to "a photoinitiator" includes reference to one or more of such materials.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. All percents are by weight (wt %) unless otherwise indicated.

The term "curing" in the context of the present disclosure refers to a process of converting a liquid composition, such as a varnish or ink, into a solid by exposure to actinic radiation such as photo radiation, e.g., ultraviolet (UV) radiation. In the uncured state, the compositions have a low viscosity and are readily jetted. However, upon exposure to a suitable source of curing energy, for example ultraviolet (UV) light, electrons beam energy, and/or the like, there is a formation of a cross-linked polymer network. Such compositions are commonly referred to as "energy-curable" compositions to distinguish them from "solvent-based" compositions.

The term "ink" in the context of the present disclosure refers to a jettable composition containing at least one pigment such that the ink composition can be used, alone or in combination with other pigmented inks, to print a coloured image. The term "ink" may refer to a group of ink compositions, each containing a different pigment, such that when used in combination in a printing process, the full spectrum of colours can be achieved—such combinations may be referred to as "CMYK inks".

The terms "adhesion promoter composition" and "varnish composition" in the context of the present disclosure refer to substantially colourless, clear or transparent jettable compositions substantially free from pigment. As the compositions are substantially free from pigment, they may be used as adhesion promoters or varnishes in the methods described herein without contributing a further subtractive effect on the CMYK inks that would substantially affect the colour of an overprinted or underprinted coloured image. It will be understood that other effects such as gamut expansion, saturation and brightness may be enhanced, particularly when the compositions are overprinted as varnish compositions.

Specifically, the term "adhesion promoter composition" in the context of the present disclosure refers to a substantially colourless, jettable composition which can be jetted onto a media substrate in a preliminary priming step before a coloured ink is jetted or overprinted onto the adhesion promoter composition to form a printed image.

Similarly, the term "varnish composition" in the context of the present disclosure refers to a substantially colourless, jettable composition which can be jetted or printed directly onto a media substrate or overprinted on top of a printed image formed using a coloured ink.

BRIEF DESCRIPTION OF THE FIGURES

FIG. 2(*b*) shows the same image formed from the same photocurable ink jetted onto a fluted polypropylene substrate with prior jetting of an adhesion promoter composition.

Figure 1:
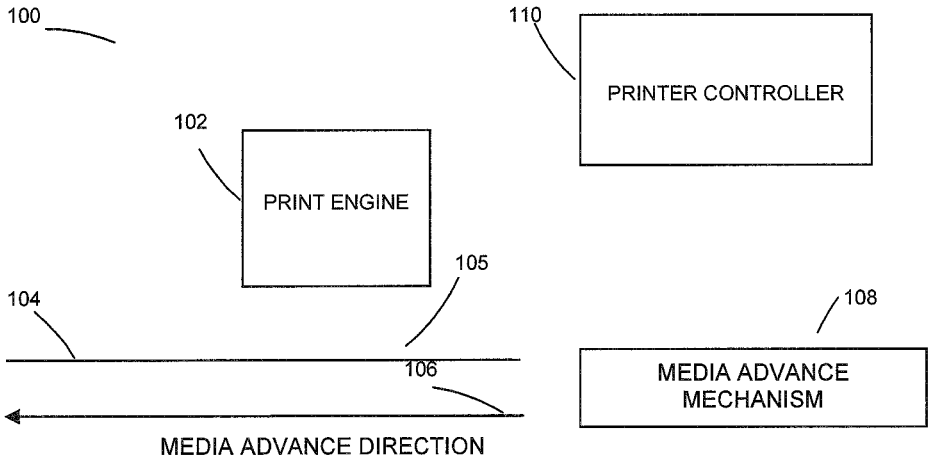
FIG. 1 is a simplified illustration of a printing system according to one example.

Described herein are methods of forming printed articles using a photo-curable adhesion promoter or varnish composition in which the composition is jetted onto a media substrate.

Also described herein is a printed article comprising an adhesion promoter composition printed onto the media substrate only at pre-determined pixel locations, and a printing ink printed on the adhesion promoter composition at the same pre-determined pixel locations.

The methods described herein use a photo-curable composition which may be referred to as a multi-functional composition or an adhesion promoter composition or a varnish composition. The composition is multi-functional in nature such that, depending on the application of use, the composition may act as a primer to promote adhesion of an overlying ink composition, i.e. act as an adhesion promoter composition, or the composition may act as a varnish, applied directly to a media substrate and/or over-printed onto a printed image. In some examples, the composition is a transparent composition. In some examples, the composition is a colourless composition.

The transparent adhesion promoter or varnish composition is photo-curable (or UV-curable or radiation-curable). The composition is a jettable composition meaning that it can be used in an ink-jet printing device. The composition is jettable as any other ink in a digital press, with the same resolution and addressability as existing inkjet ink compositions. In some examples, the composition is "substantially free of solvent".

In some examples, the same composition may be used as an adhesion promoter composition and as a varnish composition in the same printing process. In these examples, a single fluid composition may be retained in one reservoir in the printing system, and dispensed through a single color channel and print heads array, yet be jetted firstly as an adhesion promoter composition prior to printing the image, and/or then jetted as a varnish composition.

Due to the ink-jettable and multi-functional nature of this composition, its jetting can be digitally controlled, and variation of its use can be controlled on the same printing system from printed article to printed article without the need for special plates (as would be required in offset printing processes) and without having to move media to different apparatus. It will be understood that references to a multi-functional composition, to an adhesion promoter composition and a varnish composition are interchangeable, depending on the particular use.

Multi-Functional Composition as an Adhesion Promoter Composition

Inkjet ink compositions, particularly photo-curable ink compositions often have poor adhesion to non-porous or low surface energy substrates such as polyolefins (polypropylene, polyethylene) or acrylics surfaces. Polypropylene, for example fluted polypropylene, is widely used for rigid and semi-rigid Point-of-Purchase displays. Because the surface of the polypropylene is chemically inert and has low surface energy, polar compositions will not wet its surface. As a result, a poor adhesion is obtained.

Commonly used primers or adhesion promoter compositions to improve adhesion of a printed ink to a substrate are substrate specific, and are uniformly applied to the surface of the media substrate using traditional screen printing techniques, dipping, roller coating, spraying, or by hand (and creating a "flood coverage").

Once the specific primer or adhesion promoter composition has been applied, the media substrate then has to be transferred to an ink-jet printing system for the desired printed image to be applied. Such systems and methods are timely and costly, and result in wastage of adhesion promoter primer.

The transparent photo-curable composition of the present disclosure can be printed or jetted in an ink-jet printing process onto a broad selection of substrates and has a good adhesion on a variety of substrates, both porous and non-porous, specifically on plastic substrates such as PVC, acrylic, polycarbonate, polystyrene and on substrates such as polypropylene. In other examples, the photo-curable composition of the present disclosure can be printed on substrates such as cast acrylics, extrude acrylics, polyethylenes, polyesters, co-extruded polyesters, amorphous polyethylene terephthalate, rigid vinyls, for example rigid polyvinyl chloride, PETG (Polyethylene Terephthalate Glycol-modified) or any combination of any of these.

In other examples, the media substrate may be paper, paper laminated with plastic (for example, polyethylene, polypropylene, or polystyrene), cardboard, paperboard, foam board, and textiles.

When printed on a substrate and cured, the composition as described herein exhibits excellent adhesion to the substrate, particularly on rigid substrates.

The media substrate may be planar, either smooth or rough, or have any other shape that is suitable for the particular purpose for which it is employed. The media substrate can have a thickness in the range of about 0.1 mm to about 25 mm or in the range of about 1 mm to about 5 mm. The media substrate may be rigid, semi-rigid, or flexible, for example. Planar media substrates may be in the form, for example, of a film, plate, board, or sheet by way of illustration and not limitation.

In some examples, the media substrate is non-porous and has low surface tension. Non-limiting examples include plastics, PVC, banner paper, and polypropylenes, and synthetic paper, such as Yupo® synthetic paper. Banner paper is specifically configured for printing banners, has a smooth surface, and is often designed for color printing. The term "non-porous" includes surfaces that can have relatively poor water permeability, absorption, and/or adsorption. Vinyl and other plastic sheets or films, metals, coated offset media, glass, and other similar substrates are considered non-porous.

The media substrates can be non-swellable and/or are non-polar. By non-swellable, it is meant herein that the substrate surface is not swelled by any components of the composition, and no chemical bonds are formed between composition and substrate. By non-polar, it is meant herein that the substrate surface is charge-neutral, therefore adhesion to it is difficult to achieve.

The transparent photo-curable composition can therefore be used as an adhesion promoter composition or primer to promote adhesion of a photo-curable ink composition to a non-porous or low surface energy substrate such as those described above.

In some examples, the photo-curable adhesion promoter composition can be jetted onto a media substrate and cured, before an ink composition is jetted onto the media substrate to form an image. The photo-curable adhesion promoter composition of the present disclosure has good jetting properties, thus its use will not require special adaptation of the printing process.

In some examples, the photo-curable adhesion promoter composition can be jetted onto a media substrate only at those pre-determined pixel locations which are to receive jetted ink. In these examples, the printing process becomes more economical since the quantity of adhesion promoter used is reduced.

In other examples, the photo-curable adhesion promoter composition can be jetted onto all pixel locations of a media substrate, including locations other than those which are to receive jetted ink.

When used in these methods, the transparent composition described herein improves adhesion of the over-printed ink to the substrate, compared to a printed article which contains the same ink printed directly onto the substrate.

Multi-Functional Composition as a Varnish Composition

Typically, a clear protective layer or vanish is applied uniformly onto a media substrate containing a printed image, covering both printed and, where applicable, non-printed portions thereof. This is especially the case where printed articles are produced using traditional offset printing techniques.

The transparent composition described herein can also be used as a protective varnish for a printed ink, or as a texturizing and patterning material around and/or on a printed image or ink on non-printed areas. In some examples, the transparent varnish composition is applied uniformly to a media substrate, i.e. to printed areas containing a printed image and to non-printed areas. In other examples, the varnish composition is only applied to non-printed areas.

The photo-curable varnish composition has a good viscosity that enables good printing performances and enables the ability to formulate fluids suitable for inkjet application. The photo-curable varnish composition of the present disclosure thus enables high printing speed.

Furthermore, the photo-curable varnish composition as described herein exhibits high flexibility and elongation properties. Such composition is thus particularly well suited for use in digital inkjet printing. Furthermore, the printed varnished media can be folded with minimal risk of cracking and chipping.

The photo-curable adhesion promoter or varnish composition possesses good scratch resistance and weatherability; the composition supports high curing speed, operational flexibility, and enables printing at a number of print modes in various throughputs/print quality levels while having a viscosity enabling good jetting properties.

In some examples, the adhesion promoter or varnish composition has a viscosity at 25° C. of not greater than about 70 cps; of not greater than about 50 cps, or, of not greater than about 30 cps. In some other examples, the viscosity of the adhesion promoter or varnish composition is ranging from about 10 cp to about 25 cp at a jetting temperature of about 30° C. to about 60° C. The adhesion promoter or varnish composition can have a static surface tension, at 25° C., of not greater than about 40 dynes/cm.

In some examples, the adhesion promoter or varnish composition is a radiation curable composition that is able to form a cured composition having an elongation of at least 50%, or having an elongation of at least 100%, or having an elongation of at least 130%. As elongation, it is meant herein, the fact that the composition is able to stretch along curing without affecting the print quality. Cured compositions with elongation characteristics greater than about 50% are beneficially used to reduce stress cracks, improve toughness, and improve weatherability.

In some examples, the adhesion promoter or varnish composition is transparent, before and/or after curing. In some examples, the adhesion promoter or varnish composition contains substantially no pigment.

Acrylic Polymer or Copolymer

The photo-curable adhesion promoter or varnish composition comprises an acrylic polymer or copolymer. Suitable acrylic polymer or copolymers include components such as styrene acrylic resins, butyl methacrylate resins, ethyl methacrylate, isobutyl methacrylate resins, methyl methacrylate resins, styrene acrylates or copolymers thereof in any combination. In some examples, the acrylic polymer or copolymers includes polymers of methyl methacrylate, ethyl methacrylate and butyl methacrylate or any combination thereof. In some other examples, the acrylic polymer or copolymer is an isobutyl methacrylate resin.

The acrylic polymer or copolymer component may have an average molecular weight in the range of about 1,000 to about 60,000 g/mole; or, in the range of about 5,000 to about 20,000 g/mole. In some examples, the acrylic polymer or copolymer component has a glass transition temperature (Tg) that is below 60° C. The way of measuring the glass transition temperature (Tg) parameter is described in, for example, Polymer Handbook, 3rd Edition, authored by J. Brandrup, edited by E. H. Immergut, Wiley-Interscience.

Examples of acrylic polymers or copolymers include components available from Dianal America, under tradenames: MB-7022, MB-2588, BR-115, MB-2543, BR-220, MB-2823 or MB-2494 or MB-2594 or Neocryl® 300 available from DSM.

In some examples, the acrylic polymer or copolymer component is present in the adhesion promoter or varnish composition in an amount representing from about 5 to about 25 wt % of the total weight of the ink composition. In some other examples, the acrylic polymer or copolymer component is present in an amount representing from about 7 to about 20 wt % of the total weight of the ink composition.

Mono-Functional Monomer

The photo-curable adhesion promoter or varnish composition includes a mono-functional monomer. A mono-functional monomer is a compound containing one functional group that is capable of participating in a polymerization reaction during curing of the ink or coating. In particular, the mono-functional monomer has a functional group that reacts in a free radical curing reaction.

Without being linked by any theory, it is believed that the mono-functional monomer acts as a reactive diluent for the polymer or copolymer, controls viscosity, reduce shrinkage, enhance flexibility and control adhesion of the ink to the media substrate. In some examples, a combination of two or more mono-functional monomers is used in the photo-curable adhesion promoter or varnish composition in view of optimizing ink properties.

The mono-functional monomer may comprise one or more of acrylate, methacrylate or vinyl monomer. In some examples, the mono-functional monomer is selected from the group consisting of acrylic, methacrylic, vinyl type monomers and any combination of these.

The acrylate monomer can also be modified or derivatized acrylate monomer. The acrylic monomer can be selected from the group consisting of 2-phenoxyethyl acrylate, isophoryl acrylate, isodecyl acrylate, tridecyl acrylate, lauryl acrylate, 2-(2-ethoxy-ethoxy)ethyl acrylate, tetrahydrofurfuryl acrylate, isobornyl acrylate, propoxylated acrylate, tetrahydrofurfuryl methacrylate, 2-phenoxyethyl methacrylate, isobornyl methacrylate and combinations of two or more thereof.

In some examples, mono-functional monomers are vinyl monomers. Such vinyl monomer can be selected from the group consisting of vinyl caprolactam and divinyl ether and any combinations thereof. In some examples, the mono-functional monomer is selected from the group consisting of vinyl caprolactam, tetrahydrofurfuryl acrylate, 2-phenoxyethyl acrylate and isophoryl acrylate.

Commercially available mono-functional monomers include, for example, Isophoryl Acrylate CD 420 or 2-Phenoxyethyl Acrylate SR 339C (from Sartomer USA, LLC).

The mono-functional monomer can be present in the adhesion promoter or varnish composition at a level of about 1 to about 50% by weight based on the total weight of the ink. In some examples, the mono-functional monomer is present in an amount representing from about 5 to about 15 wt % based on the total weight of the adhesion promoter or varnish composition.

Vinyl Ester Component

In some examples, the adhesion promoter or varnish composition includes a vinyl ester component. The vinyl ester component is a compound that contains a divinyl ester of a dicarboxylic acid. Such compounds can contain then, at least, two vinyl esterified carboxylic acid groups. The phrase "dicarboxylic acid" refers to an organic acid that contains, for example, from 2 to 8 carbon atoms, and two carboxylic acid groups, which is, —COOH groups, for example, where the number of carbon atoms of the carboxylic acid group is included in the number of carbon atoms referred to above. Dicarboxylic acids that may be employed herein include, but are not limited to, oxalic acid, malonic acid, succinic acid, glutaric acid, adipic acid, cyclohexyl dicarboxylic acid, phthalic acid, terephthalic acid, and pimelic acid, for example.

The phrase "divinyl ester" refers to vinyl moieties that are attached to two carboxylic acid groups of the dicarboxylic acid where the form of attachment is an ester bond. The phrase "vinyl moieties" refers to organic moieties that contain, at least, one carbon-carbon double bond. The vinyl moiety may include one or more substituents in place of one or more of the hydrogen's of the vinyl moiety. Such substituents include, by way of illustration and not limitation, alkyl groups, an aryl groups, and an alkaryl groups, for example.

In some examples, the compound containing a divinyl ester of the dicarboxylic acid has a viscosity of about 0.5 to about 15 millipascal seconds (mpas), or of about 0.5 to about 10 mpas, or of about 1 to about 5 mpas. In some other examples, the divinyl ester of the dicarboxylic acid has a vapor pressure less than about 0.1 millibar (mbar), or less than about 0.01 mbar. In yet some other examples, the divinyl ester of the dicarboxylic acid has a boiling point greater than about 150° C. or greater than about 230° C.

An amount of the compound comprising a vinyl ester of a dicarboxylic acid in the adhesion promoter or varnish composition is chosen to be at an optimum amount that enables high pigment loading, good rheology, low viscosity and improved storage stability. In some examples, the vinyl ester component is present in the composition in an amount representing from about 1 to about 60 wt % of the total weight of the composition. In some other example, the vinyl ester component is present in an amount representing from about 10 to about 50 wt % of the total weight of the composition. In yet some other examples, the vinyl ester component is present in an amount representing from about 20 to about 45 wt % of the total weight of the composition.

In accordance with the principles described herein, the vinyl ester component can be adipic acid divinyl ester (AVES), cyclohexyl dicarboxylic acid divinyl ester (CHDVES), terephthalic acid divinyl ester (TVES), or any combination thereof. In some examples, the vinyl ester component is adipic acid divinyl ester (AVES). In some other examples, the vinyl ester component is AVES, which has a viscosity of about 2.5 mpas at 30° C., a vapor pressure less than 0.01 mbar and a boiling point greater than 230° C.

Multi-Functional Monomer

The photo-curable adhesion promoter or varnish composition includes a multi-functional monomer. A multi-functional monomer is a compound containing more than one functional group, each of which is capable of participating in the curing reaction, for example a polymerization reaction, during curing of the composition. Without being linked by any theory, it is believed that the multi-functional monomer enhances curing speed of the composition and may serve as a reactive diluent for the polymer or copolymer. In some examples, a combination of two or more multi-functional monomers may be used to optimize adhesion promotion or varnish properties. In some examples, the multi-functional monomer is not a vinyl ester component.

In particular, the multi-functional monomer includes more than one functional group that reacts in a free radical curing reaction, such as an ethylenically unsaturated functional group, for example a vinyl or acrylate functional group. The term "multi-functional monomer" refers to the monomer, other than mono-functional monomer, containing more than one polymerizable functional group per molecule. The multi-functional monomer can be a di-functional monomer, i.e. containing two polymerizable functional groups per molecule.

The multi-functional monomer can be an acrylate monomer containing ethylenically unsaturated radiation curable functional groups. Examples of such functional, radiation curable monomers may include 3-methyl 1,5-pentanediol diacrylate, hexanediol di(meth)acrylate, tetraethylene glycol di(meth)acrylate, trimethylolpropane tri(meth)acrylate, ethoxylated trimethylolpropane tri(meth)acrylate, tris (2-hydroxyethyl) isocyanurate triacrylate, pentaerythritol tri (meth)acrylate, ethoxylated (4) pentaerythritol tetraacrylate, neopentyl glycol di(meth)acrylate, combinations of these, and the like. In some other examples, the multi-functional monomer is selected from one or more of ethoxylated (4) pentaerythritol tetraacrylate, tetraethylene glycol diacrylate, propoxylated ethylene glycol di-acrylate, dipentaerythritol penta-acrylate, or any combination thereof. The multi-functional monomer can also be selected from one or more monomers of acrylic and methacrylic type monomers and any combination thereof.

In some examples, the multi-functional monomer is present in an amount representing from about 1 to about 30 wt % of the total weight of the photo-curable composition. In other examples, the multi-functional monomer is present in an amount representing from about 5 to about 15 wt % of the total weight of the composition.

Photo-Initiator

In some examples, the photo-curable adhesion promoter or varnish composition contains a photo-initiator. The photo-initiator, or UV initiator, is an agent that initiates a reaction upon exposure to a desired wavelength of UV light to cure the composition, as described herein, after its application to a substrate. In some examples, the photo-initiator is a radical photo-initiator. The photo-initiator may be a single compound or a mixture of two or more compounds. It can be present in the composition in an amount sufficient to cure the applied composition. In some examples, the photo-initiator is present in the composition in an amount representing from about 0.01 to about 10 wt %, or from about 1 to about 5 wt % by weight, based on the total weight of the photo-curable composition.

Examples of radical photo-initiator include, by way of illustration and not limitation, 1-hydroxy-cyclohexylphenylketone, benzophenone, 2,4,6-trimethylbenzo-phenone, 4-methylbenzophenone, diphenyl-(2,4,6-trimethylbenzoyl) phosphine oxide, phenyl bis(2,4,6-trimethylbenzoyl)phosphine oxide, 2-hydroxy-2-methyl-1-phenyl-1-propanone, benzyl-dimethyl ketal, 2-methyl-1-[4-(methylthio)phenyl]-2-morpholinopropan-1-one, or combinations of two or more of the above. Amine synergists may also be used, such as, for example, ethyl-4-dimethylaminobenzoate, 2-ethylhexyl-4-dimethylamino benzoate.

The photo-curable composition may include a UV stabilizer, i.e. an agent that can assist with scavenging free radicals. Examples of UV stabilizers include, by way of illustration and not limitation, quinine methide (Irgastab®UV 22 from BASF Corporation) and Genorad®16 (Rahn USA Corporation) and combinations thereof.

In some examples, a photosensitizer may be used with the photo-initiator in amounts ranging from about 0.01 to about 10 wt %, or from about 1 to about 5 wt %, based on the total weight of the ink composition. A photosensitizer absorbs energy and then transfers it to another molecule, usually the photo-initiator. Photosensitizers are often added to shift the light absorption characteristics of a system. Suitable examples of photosensitizers include, but are not limited to thioxanthone, 2-isopropylthioxanthone and 4-isopropylthioxanthone.

Other Components and Additives

Other components and additives may be present in the transparent photo-curable adhesion promoter or varnish composition in order to improve properties and performances. The additives include, but are not limited to, one or more of surfactants or wetting agents (e.g., surfactants containing silicone compounds or fluorinated compounds), rheology modifiers, anti-molding agents, anti-foaming agents, and stabilizers such as, e.g., storage stability enhancing agents, for example. The total amount by weight of additives in the composition is, for example, from about 0.1 to about 1 wt % or, from about 0.2 to about 0.5 wt %.

Surfactants include, for example, those commercially available under the brand names: WET® and GLIDE® (from Evonik Tego Chemie GmbH, Essen, Germany); BYK® (from BYK Chemie GmbH, Wesel, Germany); Dynax® (from Dynax Corp. Pound Ridge N.Y.); 3M Novec® (from 3M Energy and Advanced Materials, St. Paul Minn.); and Zonyl® FSO (from DuPont de Nemours Company, Wilmington Del.).

Examples of anti-foaming agents are those commercially available under the brand names: Foamex® and Twin® (from Evonik Tego Chemie Service GmbH); BYK® (from BYK Chemie GmbH); and Surfynol® (from Air Products and Chemicals, Inc.).

Examples of rheology modifiers include, those commercially available under the brand names: Acrysol® (from Rohm & Haas); Borchigel® (from OMG Borchers GmbH, Langenfield, Germany); BYK® (from BYK Chemie GmbH); and DSX® (from Cognis GmbH, Monheim am Rhein, Germany).

Methods for Forming Printed Articles

In accordance with the principles described herein, the colourless or transparent photo-curable compositions find use in inkjet printing processes as adhesion promoter compositions, also referred to herein as primers for improving adhesion of photo-curable inks to a substrate, and also as varnish compositions. In some examples, the colourless or transparent photo-curable compositions may be dispensed to the surface of a broad range of substrates employing inkjet technology and equipment.

In one example, a method for forming a printed article comprises: providing a photo-curable adhesion promoter composition; providing a photo-curable ink; providing a media substrate; jetting the photo-curable adhesion promoter composition onto the media substrate; curing the photo-curable adhesion promoter composition; jetting the photo-curable ink onto the media substrate at pre-determined locations to form a printed image; and curing the photo-curable ink.

In some examples, the photo-curable adhesion promoter composition is jetted onto the media substrate only at the pre-determined locations where the photo-curable ink composition is to be jetted. In other examples, the photo-curable adhesion promoter composition is jetted onto the media substrate at the pre-determined locations where the photo-curable ink composition is to be jetted, and at locations other than the pre-determined locations.

In some examples, a photo-curable varnish composition is subsequently jetted onto the media substrate and cured. In some examples, the photo-curable varnish composition is the same composition as the adhesion promoter composition. In these examples, a single composition can be stored in a reservoir and dispensed through a single color channel and print heads array, either as an adhesion promoter composition or a varnish composition. The varnish composition may be jetted onto the media substrate surrounding the printed image, and/or on top of the printed image. Jetting the varnish composition onto the media substrate surrounding the printed image results in a more efficient process as the protective varnish composition can be printed in the same run as the color inks with no reduction of throughput as would occur if the varnish was applied before or after the color inks.

In other examples, a method for forming a printed article comprises: providing a photo-curable varnish composition; providing a photo-curable ink; providing a media substrate; jetting the photo-curable ink onto the media substrate only at pre-determined locations; jetting the photo-curable varnish composition onto the media substrate; curing the photo-curable ink; and curing the photo-curable varnish composition.

In some examples, the photo-curable varnish composition is jetted onto the media substrate onto pre-determined locations of the media substrate which are other than the pre-determined locations which receive the jetted ink. In other words, the photo-curable varnish composition is jetted onto the bare substrate around the printed image, but not on top of the printed image.

In these examples, use of the varnish composition in combination with a high-gloss color ink provides for a uniform gloss across the substrate surface without unnecessarily printing varnish on top of the color image. Protection against rubbing or moisture for the areas of the media substrate which do not receive any color ink is also provided. In these examples, the varnish composition and the ink composition, for example a CMYK ink, may be printed simultaneously. In other examples, the photo-curable varnish composition is jetted onto the printed image and onto the media substrate around the printed image.

In some examples, the photo-curable varnish composition is jetted onto the media substrate onto pre-determined locations in order to create localized effects on the printed article. Such effects may include localised visual effects such as a "spot gloss" or a "spot varnish" only at those pre-determined locations. In these examples, the pre-determined locations may be on top of a printed image, or at locations other than on top of a printed image.

In some examples, the photo-curable varnish composition is jetted onto the media substrate more than once. In these examples, each layer of jetted photo-curable varnish composition is cured prior to jetting of the next layer of photo-curable varnish composition. Build-up of layers of cured varnish results in a particular texture to the final printed article. For example, repeated jetting and curing of the varnish composition to pre-determined locations of a media substrate can result in regions of higher gloss.

Alternatively, repeated jetting and curing of the varnish composition to pre-determined locations of a media substrate can result in a three-dimensional visual effect, such as an embossing-like effect, with regions of the printed article being raised relative to the rest of the media substrate.

The greater the number of applications of the varnish composition, the greater the embossing-like effect. In these examples, the photo-curable varnish composition may be jetted on top of a printed image, or directly onto a media substrate at locations which do not contain a printed image.

In some examples, curing of the photo-curable varnish composition takes place immediately after it has been jetted onto the media substrate. In other examples, curing of the photo-curable varnish composition takes place after a pre-determined time lapse. Through selection of an appropriate time lapse, a print operator can select whether the cured varnish composition exhibits a matte, silk or gloss effect.

Briefly, if the varnish composition is cured immediately after jetting (microseconds), the resultant effect will be a matte effect, whereas if a certain period of time is allowed to lapse between jetting and curing, a gloss effect will be achieved. In one example, curing of varnish may be delayed for between about 5 and 60 seconds. For example, a lapse of at least 8 seconds will result in a gloss appearance. In other examples, curing of varnish may be delayed for a shorter or longer length of time.

The use of the composition as an over-printed varnish composition results in a reduction in the odor produced by the printed article. For example, CMYK printing inks can be more odorous than the varnish. The composition described herein can be over-printed onto a CMYK ink image, and the odor from the CMYK ink is suppressed.

When used as an adhesion promoter composition and/or as a varnish composition, the multi-functional composition described herein may enable heat bending of photo-curable inks which have been printed on plastic substrates. Photo-curable CMYK inks exhibit poor performance in this regard due to cracking of the ink, which may be prevented from cracking due to the elongation properties of the multi-functional composition.

When used as a varnish composition over-printed onto a color image, the multi-functional composition described herein enables an increase in the color gamut, or a gamut expansion, of the color image relative to the same image without an over-printed varnish layer.

In some examples, a method for forming a printed article comprises: providing a photo-curable multi-functional composition; providing a photo-curable ink; providing a media substrate; jetting the photo-curable multi-functional composition onto the media substrate as a photo-curable adhesion promoter composition at pre-determined locations which are to receive printed ink; curing the photo-curable adhesion promoter composition; jetting the photo-curable ink onto the media substrate at those pre-determined locations to form a printed image; curing the photo-curable ink; jetting the photo-curable multi-functional composition onto the media substrate as a photo-curable varnish composition; and curing the photo-curable varnish composition.

In some examples, the projection of stream of droplets of ink composition, and adhesion promoter or varnish composition onto the media substrate, is done via an inkjet printing technique, i.e. the compositions are jetted onto the media substrate. The ink composition, and adhesion promoter composition or varnish composition may be established on the material via any suitable printing technique, such techniques include thermal, acoustic, continuous and piezoelectric inkjet printing. In inkjet printing devices, liquid drops are applied in a controlled fashion to a receiving substrate, or media substrate, by ejecting droplets from a plurality of nozzles, or orifices, in a printhead of an inkjet printing device or inkjet printer.

In drop-on-demand systems, a droplet is ejected from an orifice directly to a position on the surface of an receiving substrate, or media substrate, by pressure created by, for example, a piezoelectric device, an acoustic device, or a thermal process controlled in accordance digital data signals.

For inkjet printing, the ink composition and the adhesion promoter or varnish composition can be heated or chilled to an appropriate dispensation temperature, prior to ejecting the composition to the surface of a substrate. Considerations regarding temperature and viscosity of the composition relate to the effect on droplet size and droplet ejecting rate, for example.

For applying photo energy, the photo-curable multi-functional composition (which may be used as an adhesion promoter composition or as a varnish composition), after jetting onto the media substrate, may be subjected to suitable light sources for curing the compositions in accordance with the principles described herein.

Ultraviolet (UV) radiation can be used to cure the compositions as described above. Curing radiation can be UV radiation radiated by UV lamps, blue lasers, UV lasers, or ultraviolet LEDs, for example. The curing radiation may be provided by a source of ultraviolet radiation operating in a continuous mode. The curing radiation may also be provided by a source of ultraviolet operating in a flash or pulsed mode.

Also described herein is a printer or printing system to print a jettable adhesion promoter composition and a jettable ink composition onto a media substrate.

Referring now to FIG. 1, there is shown a simplified illustration of a printer or printing system 100 according to one example. The printing system 100 comprises a print engine 102 for printing on a substrate, such as a substrate 104. The substrate 104 is advanced through a print zone 105 of the print engine 102 by a media advance mechanism 108 in a media advance direction 106.

In one example the media advance mechanism 108 may include one or multiple rollers. In another example the media advance mechanism 108 may include a transport belt or other suitable media advance device, for example a "flat bed" printing device.

The operation of the printing system 100 is generally controlled by a printer controller 110.

In one example the print engine 102 is an inkjet print engine that comprises one or multiple inkjet printheads. Each printhead comprises an array of printhead nozzles through which drops of printing fluid may be selectively ejected. The arrangement and spacing of the nozzles in the printhead defines a printing resolution of the printing system 100.

In one example the nozzles may be arranged to allow the printing system 100 to print at resolutions of up to 600 dots per inch (DPI). In other examples the nozzles may be arranged to allow the printing system 100 to print at other higher or lower resolutions, such as 300 DPI and 1200 DPI.

The resolution of the printing system 100 together with the width of the substrate to be printed on defines the number of pixel locations on a substrate that are printable on across the width of the substrate.

The printheads are controllable by the printer controller 110, in accordance with image data, such as printhead control data, representing an image to be printed, to eject drops of printing fluid, such as ink and adhesion promoter or varnish onto substrate pixel locations on a substrate positioned in the print zone 105.

In one example the printheads are mounted on a carriage (not shown) movable bi-directionally in an axis perpendicular to the media advance direction 106. In another example the printheads are configured to span the entire width of the media 105 such that the printheads do not need to scan across the print zone, in a so-called page-wide array configuration.

In one example the printheads are piezo inkjet printheads. In another example the printheads are thermal inkjet printheads.

Where the print engine 102 comprises multiple inkjet printheads each printhead may be configured to print with a different printing fluid, such as different coloured printing inks, adhesion promoter compositions, or varnish compositions. In one example, the print engine 102 may have five printheads each configured to print with one of a cyan (C), magenta (M), yellow (Y), black (K) coloured ink, or the colourless adhesion promoter and varnish composition described herein. Printing fluid may be supplied to each printhead by a suitable supply system (not shown).

In one example the printing fluids used by the print engine 102 are ultra-violet curable printing fluids, such as the range of Hewlett-Packard UV curable inks available from Hewlett-Packard Company, that are printed in liquid form and which are cured after printing through exposure to ultra-violet radiation from a UV radiation source.

In one example, one or multiple UV radiation sources are provided in proximity to the print engine to cure or pin (i.e. partially cure) printed UV curable ink, and adhesion promoter or varnish compositions.

Also described herein is a transparent adhesion promoter or varnish composition, the composition comprising an acrylic polymer or copolymer; a mono-functional monomer and/or a vinyl ester component; a multi-functional monomer component; and a photo-initiator. Also described herein is a transparent adhesion promoter or varnish composition, the composition comprising an acrylic polymer or copolymer; a mono-functional monomer and/or a vinyl ester component; a multi-functional monomer component; and a photo-initiator, the composition containing substantially no pigment. Particular components of the transparent adhesion promoter or varnish composition containing substantially no pigment may be selected from those described previously.

Also described herein is a method for preparing the above mentioned photo-curable multi-functional composition which may be used as an adhesion promoter composition or a varnish composition. The method includes providing, in combination, an acrylic polymer or copolymer, a mono-functional monomer and/or a vinyl ester component, a multi-functional monomer, and a photo-initiator; subjecting the combination to conditions under which the composition becomes substantially uniform and have viscosity and surface tension suitable for jetting; and subjecting the combination to filtration.

In another example, the photo-curable composition can be prepared by dissolving an acrylic polymer or copolymer in mono-functional monomer and/or vinyl ester component under high-shear. The resulting solution can then be mixed with multi-functional monomer, and the photo-initiator system can then be added to the mix. The mixture is subsequently subjected to high shear mixing in view of dissolving the photo-initiator. The mixture becomes uniform and can be subjected to filtration.

EXAMPLES

An adhesion promoter composition was prepared in the proportions indicated in Table 1.

TABLE 1

Example adhesion promoter composition

| Component Name | Ingredient Type | Supplier | Amount (wt %) |
|---|---|---|---|
| BYK 307 | Surfactant | BYK | 0.2 |
| MB 2594 | Acrylic polymer | Dianal | 11.3 |
| CN9196 (30-40%) + pentaerythritol tetraacrylate (60-70%) | Multi-functional acrylate oligomer/ multi-functional monomer | Sartomer/Sigma Aldrich | 4 |
| CD420 | Mono-functional monomer | Sartomer | 18.7 |
| SR339 (2-phenoxyethyl monoacrylate) | Mono-functional monomer | Sartomer | 60.4 |
| Omnirad TPO | Photoinitiator | IGM Resins | 2.9 |
| Irgacure 819 | Photoinitiator | BASF Corporation | 2 |
| Genorad 16 | Stabiliser | Rahn USA Corp | 0.5 |

Using an HP Scitex FB7600 industrial press, the adhesion promoter composition of Table 1 was jetted onto various substrates at pixel locations where an image was to be printed, and irradiated under a UV lamp until cured.

An HP photo-curable acrylate based full colour CMYK ink commercially available under the brand of FB225 Scitex inks, was then used to print an image onto the same media substrate, on top of the cured adhesion promoter composition, and irradiated until cured.

Adhesion of the FB225 Scitex ink was tested in accordance with ASTM D3359-02, and compared to adhesion of the same printed ink which had been printed directly onto each media substrate, i.e. without prior printing of the adhesion promoter composition. The adhesion is evaluated and scored on a scale of 1 to 5 where: a score of 1 illustrates a very poor adhesion to substrate, a score of 2 illustrates a poor adhesion, a score of 3 illustrates a fair adhesion, a score of 4 illustrates a good adhesion and a score of 5 illustrates a very good adhesion to substrate.

Figure 2A:
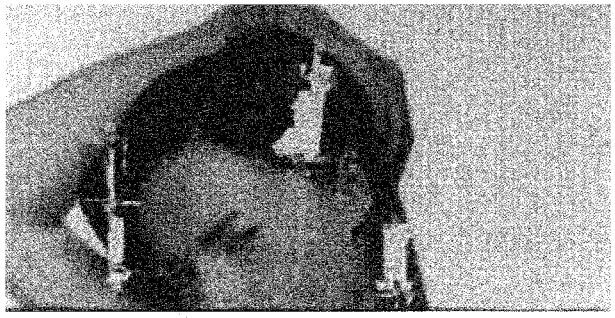
FIG. 2(*a*) shows an image formed from a photocurable ink jetted onto a fluted polypropylene substrate without prior jetting of an adhesion promoter composition.
Figure 2B:
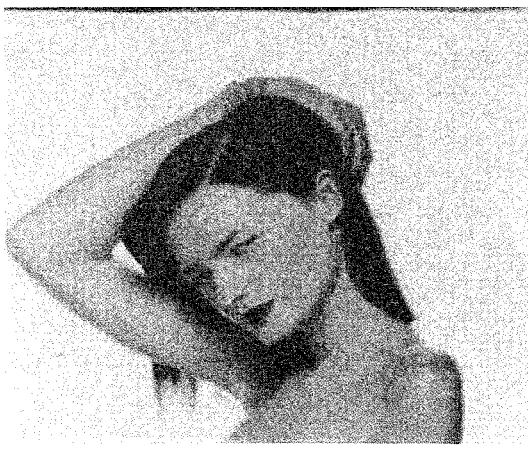

FIGS. 2(*a*) and (*b*) show images printed on fluted polypropylene substrates using the CMYK FB225 Scitex ink without use of an adhesion promoter composition (FIG. 2(*a*)) and with use of the adhesion promoter composition of Table 1 (FIG. 2(*b*)).

A summary of the adhesion testing on different substrates can be found in Table 2, which shows an improvement of adhesion of the acrylic based CMYK FB225 ink to fluted polypropylene and acrylic media when the adhesion promotion composition is first jetted onto the media.

As can be seen in FIGS. 2(*a*) and 2(*b*), and Table 2, pre-printing of media articles using an adhesion promoter composition as described herein improves adhesion of a subsequently printed image to fluted polypropylene media and acrylic substrates.

TABLE 2

Adhesion of FB225 inks to media substrates with and without use of an adhesion promoter composition, measured according to ASTM D3359-02.

| Media | Manufacturer | FB225 ink with no adhesion promoter underprinting | FB225 ink with under printed adhesion promoter |
|---|---|---|---|
| SAV | 3M | 5 | NR |
| PVC | Ineos, Bilcare | 5 | |
| | Palopaque, Palram | 5 | |
| Foam PVC | Palram | 5 | |
| Polystyrene | Unknown | 4 | |
| Polycarbonate | Palram | 5 | |
| Synthetic Paper | Yupo | 5 | |
| Fluted PP | Polygal | 2-3 | 4-5 |
| Fluted PP | Kysersberg | 3 | 4-5 |
| Fluted PP | Treated | 4 | NR |
| Acrylic | Palram | 1 | 5 |

Investigations into print production capabilities of the composition of Table 1 indicated that the composition performed as any other jettable printing composition, thus providing a composition that can be used as an adhesion promoter and printed or jetted from a printhead installed on a conventional inkjet printer. This therefore enables highly selective and efficient printing of an adhesion promoter onto a media substrate prior to an inkjet ink being printed on top of the adhesion promoter from the same printer. Using an adhesion promoter as described herein, in a conventional inkjet printer, allows for more selective deposition of the adhesion promoter rather than "flood coverage", meaning that no adhesion promoter is deposited onto areas of the substrate on which it is not needed.

Due to its jettability, the composition of Table 1 was also investigated as a varnish composition, printed on regions of media substrates surrounding a printed CMYK image, and also as a topcoat varnish overprinted onto a printed image.

Jetting of a CMYK ink to form a printed image on a media substrate, with concomitant jetting of the composition of Table 1 on those regions of the naked media substrate surrounding the image led to a uniform gloss effect over the entire surface of the substrate, and also provided a protective layer on regions of the substrate not containing the CMYK ink image. Dependent on the time lapse between jetting and curing, gloss or matte effects could be achieved.

Furthermore, varnish compositions of the type described herein are amenable to repeat printing passes on top of previous print layers in a print-cure-print-cure type process. This type of process, with at least four cycles of print-cure leads to a visual and textural appearance, with the repeat print regions appearing in relief, in an embossing-type effect.

Pigment free compositions of the type described herein therefore enable more efficient methods of printing which use reduced amounts of adhesion primer and which result in improved adhesion of a printing ink to a media substrate; extended gloss appearance of the printed article; a color gamut expansion; and greater color density.

The invention claimed is:

1. A method of forming a printed article by inkjet printing, comprising:

a. providing a photo-curable varnish composition having a viscosity ranging from about 10 cp to about 25 cp at a jetting temperature ranging from about 30° C. to about 60° C., wherein the photo-curable varnish composition is substantially colorless;

b. providing a photo-curable ink;

c. providing a media substrate;

d. jetting the photo-curable ink onto the media substrate only at pre-determined locations;

e. jetting the photo-curable varnish composition onto the media substrate;

f. curing the photo-curable ink; and g. curing the photo-curable varnish composition;

wherein the photo-curable varnish composition includes:

about 5 wt % to about 25 wt % of an acrylic polymer or copolymer;

a divinyl ester of a carboxylic acid;

a multi-functional monomer component; and a photo-initiator.

2. The method of claim 1, wherein the photo-curable varnish composition comprises:

about 1 wt % to about 60 wt % of the divinyl ester of the carboxylic acid;

about 1 wt % to about 30 wt % of the multi-functional monomer component; and about 0.01 wt % to about 10 wt % of the photo-initiator.

3. The method of claim 1, wherein jetting the photo-curable ink and jetting the photo-curable varnish composition are carried out simultaneously, followed by simultaneous curing of the photo-curable ink and the photo-curable varnish composition.

4. The method of claim 1, wherein jetting the photo-curable ink composition and jetting the photo-curable varnish composition are carried out sequentially, with the curing of the photo-curable ink taking place before the jetting of the photo-curable varnish composition.

5. The method of claim 1, wherein the photo-curable varnish composition is jetted onto pre-determined locations of the media substrate which are other than the pre-determined locations which receive the photo-curable ink.

6. The method of claim 1, wherein the photo-curable varnish composition is jetted onto pre-determined locations of the media substrate which include the pre-determined locations which receive the photo-curable ink.

7. The method of claim 1, wherein jetting the photo-curable varnish composition and curing the photo-curable varnish composition are repeated more than once.

8. A method of forming a printed article comprising:

a. providing a photo-curable adhesion promoter composition having a viscosity ranging from about 10 cp to about 25 cp at a jetting temperature ranging from about 30° C. to about 60° C., wherein the photo-curable adhesion promoter composition is substantially colorless;

b. providing a photo-curable ink;

c. providing a media substrate;

d. jetting the photo-curable adhesion promoter composition onto the media substrate;

e. curing the photo-curable adhesion promoter composition;

f. jetting the photo-curable ink onto the media substrate at pre-determined locations to form a printed image; and g. curing the photo-curable ink;

wherein the photo-curable adhesion promoter composition includes:

an acrylic polymer or copolymer;

a divinyl ester of a dicarboxylic acid;

a multi-functional monomer component; and a photo-initiator.

9. The method of claim 8, further comprising:

h. jetting a photo-curable varnish composition onto the media substrate; and i. curing the photo-curable varnish composition.

10. The method of claim 9 wherein the photo-curable varnish composition includes:

about 5 wt % to about 25 wt % of an acrylic polymer or copolymer;

a mono-functional monomer, wherein the mono-functional monomer includes one or more monomers selected from the group consisting of acrylate, methacrylate and vinyl monomers;

a multi-functional monomer component; and a photo-initiator.

11. The method of claim 9 wherein the photo-curable adhesion promoter composition and photo-curable varnish composition are the same composition, the composition comprising:

about 5 wt % to about 25 wt % of the acrylic polymer or copolymer;

about 1 wt % to about 60 wt % of the divinyl ester of the dicarboxylic acid;

about 1 wt % to about 30 wt % of the multi-functional monomer component; and about 0.01 wt % to about 10 wt % of the photo-initiator.

12. The method of claim 8 wherein the photo-curable adhesion promoter composition is jetted onto the media substrate only at the pre-determined locations where the photo-curable ink is to be jetted.

13. The method of claim 8 wherein the media substrate comprises a polypropylene substrate or an acrylic substrate.

* * * * *